United States Patent [19]

Hardt

[11] Patent Number: 5,021,616

[45] Date of Patent: Jun. 4, 1991

[54] SWITCH COVER

[75] Inventor: Thomas T. Hardt, Missouri City, Tex.

[73] Assignee: Compaq Computer Corporation, Houston, Tex.

[21] Appl. No.: 431,337

[22] Filed: Nov. 3, 1989

[51] Int. Cl.[5] ..... H01H 9/20

[52] U.S. Cl. ..... 200/43.16; 200/43.18; 200/43.17; 200/318.1; 200/333; 200/334; 174/67

[58] Field of Search ..... 200/43.02, 43.11, 43.13, 200/43.15, 43.16, 43.17, 43.18, 43.19, 43.21, 43.22, 318.1, 321, 322, 334, 333, 338; 439/133, 134, 135, 136–141, 149, 188; 174/66, 67

[56] References Cited

U.S. PATENT DOCUMENTS

| | | | |
|---|---|---|---|
| 2,873,333 | 2/1959 | Jacaman | 200/43.18 X |
| 3,142,227 | 7/1964 | Stringer | 200/334 X |
| 3,158,726 | 11/1964 | Morgan | 200/43.18 |
| 3,678,236 | 7/1972 | Hughes | 200/43.18 |
| 3,929,035 | 12/1975 | Cohn | 200/43.18 X |
| 4,504,707 | 3/1985 | Ochiai | 200/43.17 |
| 4,605,270 | 8/1986 | Aslizadeh | 439/140 |
| 4,857,004 | 8/1989 | Poirier | 439/140 |

FOREIGN PATENT DOCUMENTS

| | | | |
|---|---|---|---|
| 1249049 | 1/1989 | Canada | 174/67 |
| 2012120 | 7/1979 | United Kingdom | 439/137 |

*Primary Examiner*—Ernest G. Cusick

*Attorney, Agent, or Firm*—Pravel, Gambrell, Hewitt, Kimball & Krieger

[57] ABSTRACT

A power switch cover having an elongate base member with a track formed therein and adapted to support a sliding member which includes an end portion to protect a recessed switch. The switch is accessible through the base member and once turned on is protected by the sliding member. The sliding member includes at least one spring for biasing the sliding member against the base member and provides for continuous contact of said sliding member with the track of said base member. A top member is inserted over the sliding member and the base member to provide the contact points for the spring thereby biasing the sliding member against the recessed track.

2 Claims, 4 Drawing Sheets

SWITCH COVER

BACKGROUND OF THE INVENTION

This invention relates to an improved switch cover. More particularly, this invention relates to an improved power switch cover which is adapted to slide over a power switch thereby preventing it from being inadvertently turned off.

In a number of industries, particularly the computer industry, it is desirable to ensure that the unit in operation is not inadvertently disconnected or turned off. This is particularly important for a computer processing unit which is in operation. If the operator inadvertently turns the power switch off, the results can be detrimental, resulting in downtime and lost data. This situation is exacerbated if the computer is a file server communicating with a large number of workstations..

Power switches are most conveniently located on the front of computers so that they are readily accessible. Back mounting locations have interference with the various cables and require reaching around the computer. Side mounting locations are often inconvenient if the computer is to be placed next to a fixed object such as a partition, wall or desk. Top mounting locations are inconvenient if the computer is to be placed under a desk or table. However, if the switch is on the front of the computer it can be inadvertently used, particularly by inexperienced users, who may confuse the power switch with other switches appearing on the front of the computer.

Accordingly, there is a need for an improved switch cover which can be located over the power switch after it has been turned on to ensure that the operator does not accidentally or inadvertently turn the unit off.

SUMMARY OF THE INVENTION

The present invention is an improved switch cover which comprises a base member having an aperture to circumscribe the switch. A sliding member is adapted for movement along the longitudinal axis of the base member. The sliding member includes an end portion which, when slid across the aperture of the base member, covers the switch and protects it from contact with the operator or other persons. The sliding member also includes a spring system to bias the sliding member against the base member thereby providing a smooth sliding movement.

The present invention may include a top member which contacts the base member and the spring system for biasing the sliding member against the base member. Alternatively, the sliding member may be biased via the spring system towards the top member.

If the sliding member is biased against the base member as in the preferred embodiment, the base member preferably should include a recessed track to guide the sliding member. If the sliding member contacts the top member as in the alternative, the top member should include the recessed track.

Examples of the more important features have been summarized rather broadly in order that the detailed description may be better understood. There are, of course, additional features of the present invention which will be described hereafter and which will also form the subject of the claims appended hereto.

BRIEF DESCRIPTION OF THE DRAWINGS

In order to more fully understand the drawings used in the detailed description of the present invention, a brief description of each drawing is provided.

DETAILED DESCRIPTION OF THE DRAWINGS

Figure 1:
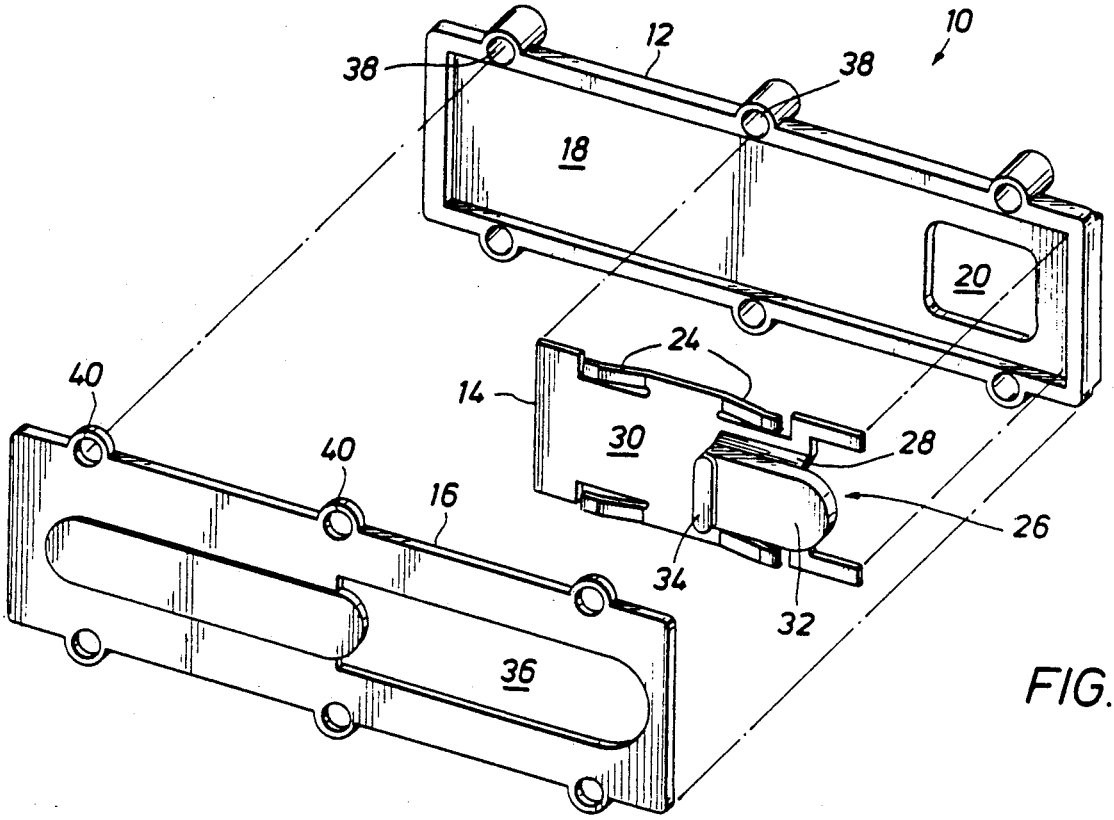
FIG. 1 is a disassembled perspective view of the present invention.
Figure 2:
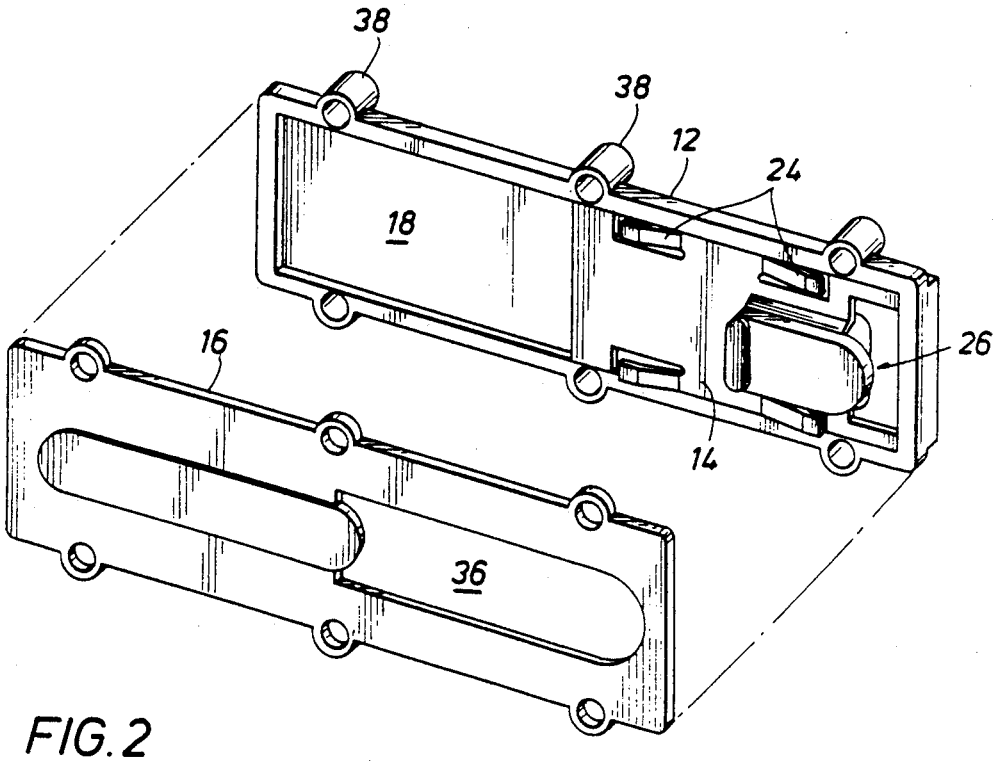
FIG. 2 is a partially assembled perspective view of the present invention.

Referring to FIGS. 1–6, a power switch cover assembly 10 is shown comprising a base plate member 12, a sliding switch cover 14 and a top plate member 16. The base plate member 12 includes a recessed track 18 which extends along the longitudinal axis of the base plate member. Base plate member 12 also includes an aperture 20 which is adapted to circumscribe a power switch 22 (shown in phantom lines in FIGS. 4–6).

The sliding switch cover 14 includes spring members 24 which are an integral part of the sliding member 14 but are biased in one direction. In the case of the preferred embodiment, spring members 24 are biased towards the top plate member 16. The sliding member 14 also includes an elevated portion 26 which is used to cover the power switch 22 when the sliding member 14 is slid across the aperture 20 of the base plate member 12. The elevated portion 26 includes side walls 28 which extend from the flat portion 30 of the sliding member 14. The other end of walls 28 are integrally formed with a top plate 32 having a detent 34. When slid across the switch 22, the top portion 32 prohibits inadvertent contact with the power switch 22. The detent 34 is used for finger contact to move the sliding member 14 within the recessed portion 18 of the base plate member 12.

The present invention may include a top plate member 16 having an aperture 36. Aperture 36 is intended to circumscribe the elevated portion 26 of sliding member 14 once the present invention is assembled.

Figure 3:
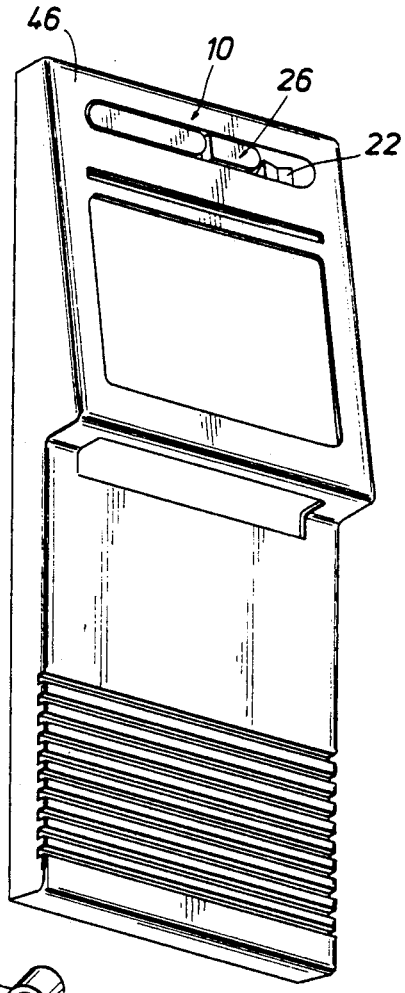
FIG. 3 is a perspective view of the present invention installed in the face plate of the computer processing unit.

The base plate member 12 includes apertures 38 which are formed around its outer periphery. Top plate member 16 includes similarly oriented apertures 40. Once assembled, apertures 38 and 40 are aligned thereby permitting screws or other fasteners 44 to pass through the aperture and threadably engage with front cover 46 of the computer unit as shown in FIG. 3.

Figure 6:
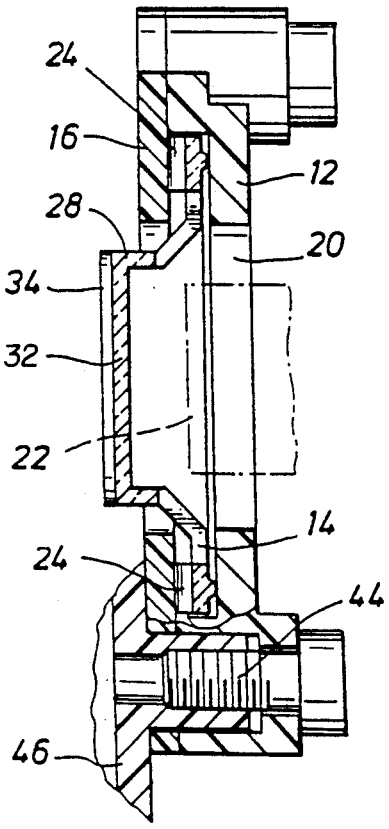
FIG. 6 is a cross-sectional end view of the present invention.
Figure 7:
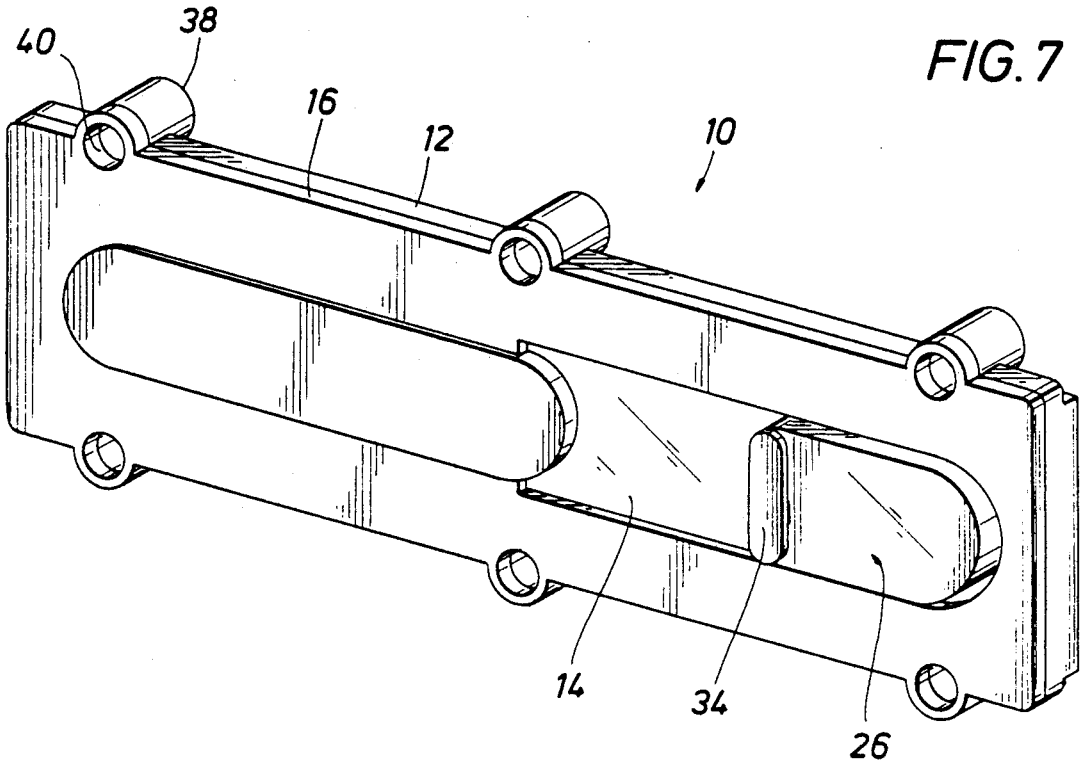
FIG. 7 is an assembled perspective view of the present invention.
Figure 8:
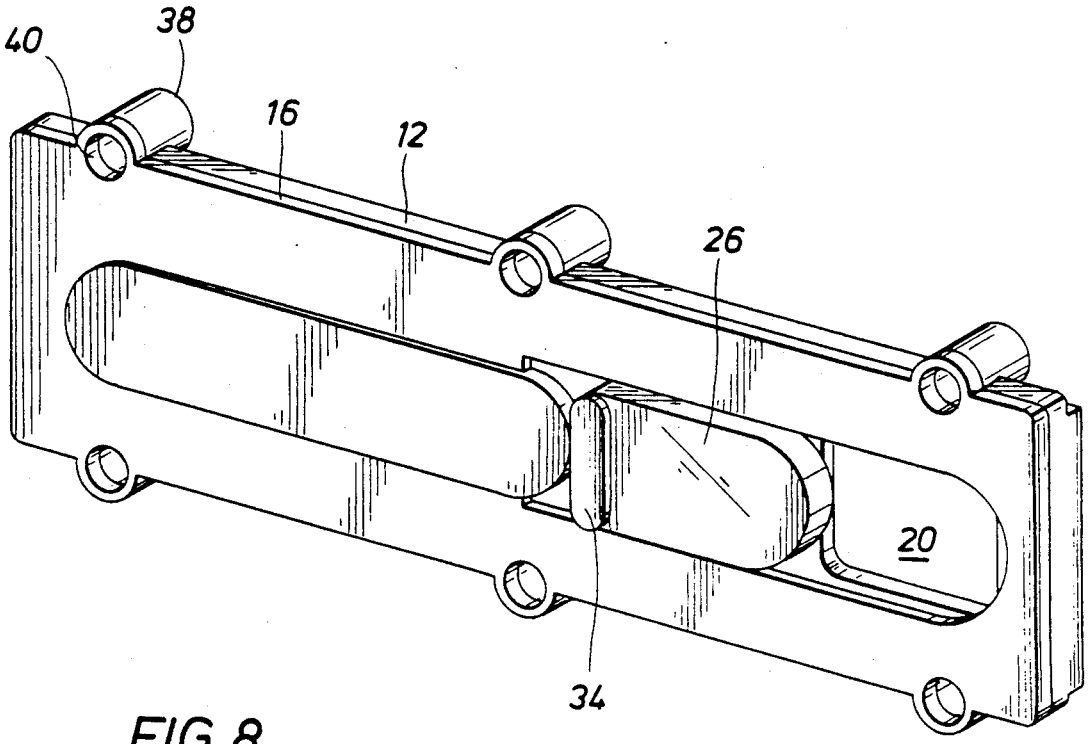
FIG. 8 is another assembled perspective view of the present invention.

Referring to FIGS. 1–2 and 6–7, the assembly of the power switch cover 10 is illustrated. The sliding member 14 is placed within the recessed portion 18. The spring members 24 engage the top plate member 16 in a compressive manner thereby forcing the sliding member 14 within the recessed area 18. This promotes a smooth sliding motion within the recessed area 18. Preferably, spring members 24 are integrally formed with the sliding member 14 and take the form of a cantilever beam having a residual bias towards the top plate member 16. The top plate member 16 is then placed over the sliding member 14 and the base plate member 12. Apertures 40 and 38 are aligned as shown in FIGS. 7–8. FIG. 7 shows the elevated portion 26 of the sliding member 14 at the far right of aperture 36. In this position, the sliding member 14 covers the power switch 22 thereby prohibiting the operator from inadvertently contacting the switch. With reference to FIG. 8, the elevated portion 26 of the sliding member has been moved to the far left of aperture 36 showing the aperture 20 through which the power switch extends.

Figure 9:
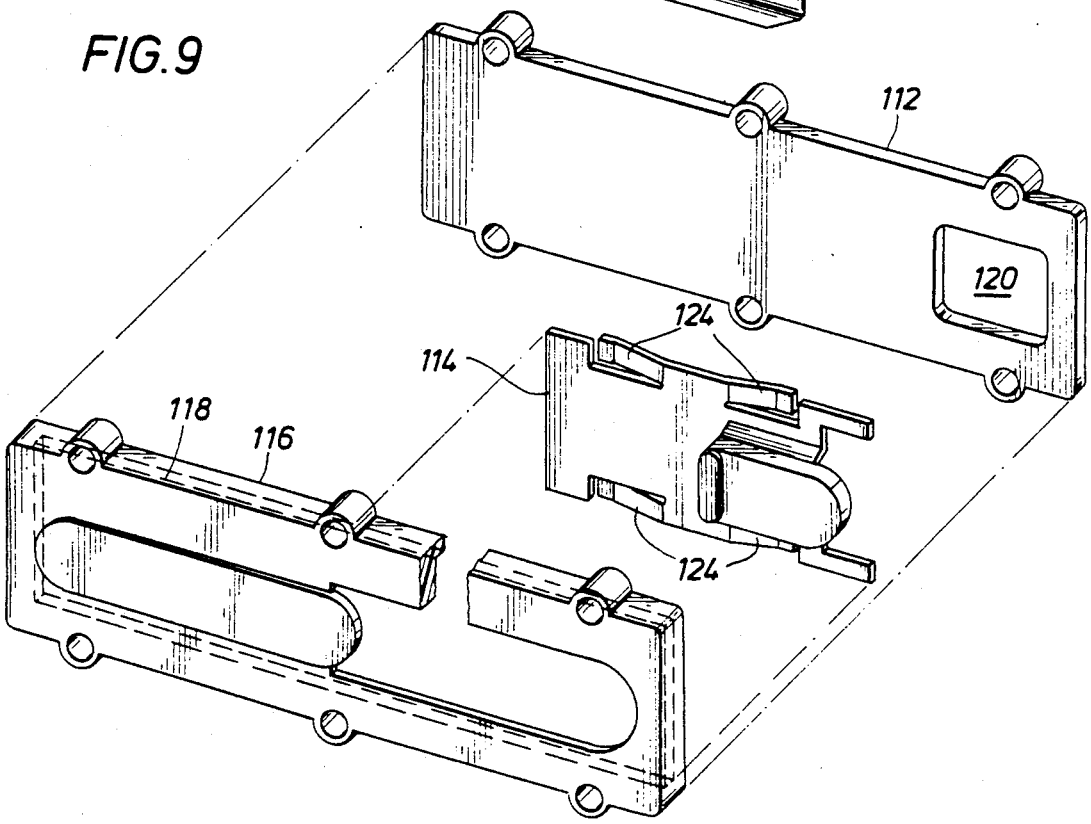
FIG. 9 is an alternate embodiment of the present invention.
Figure 4:
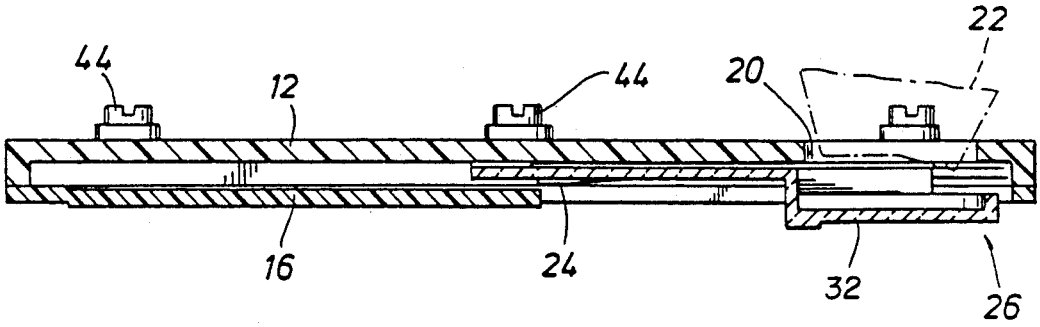
FIG. 4 is a cross-sectional plan view of the present invention.

Referring to the alternate embodiment shown in FIG. 9, a recessed track 118 is formed along the longitudinal axis of a top plate member 116 rather than a base plate member 112 as in the preferred embodiment. The base plate member 112 includes an aperture 120 through which the power switch is accessible. The sliding member 114 includes spring members 124. However, spring members 124 are biased in a rearward direction with reference to FIG. 9 and contact the base plate member 112 once assembled. In this manner, sliding member 114 is biased within recessed track 118 of the top plate member 116. Thus, in this alternate embodiment, the base plate member 112 also serves to compress the spring members 124 and promotes a free sliding motion of sliding member 114 within recessed track 118 of top member 116. Otherwise, the remaining portions of the alternate embodiment of the present invention are similar to that of the preferred embodiment and function in the same manner as described above.

Figure 5:
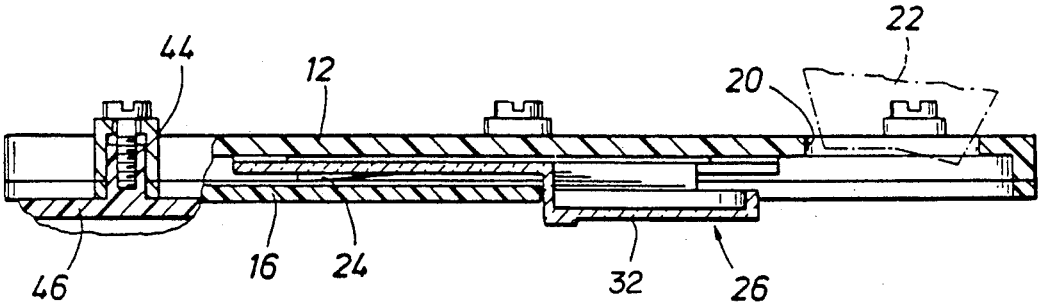
FIG. 5 is another cross-section plan view of the present invention.

To install the present invention the power switch assembly 10 is assembled as described above with reference to FIGS. 7–8. Screws or fasteners 44 are then inserted through the rear of the base plate member 12 and attached to the front cover 46 as shown in FIGS. 3 and 5–6.

Preferably, the present invention is made of plastic using state-of-the-art injection molding techniques well known to those skilled in the art.

The present invention has been described in terms of particular embodiments. Obviously, modifications and alternations to these embodiments will be apparent to those skilled in the art in view of this disclosure. It is, therefore, intended that all such equivalent modifications and variations fall within the spirit and scope of the present invention as claimed.

I claim:

1. A switch cover comprising:

an elongate base member having an aperture adapted to circumscribe a switch, outer edges and a recessed track extending along a central portion of a longitudinal axis of said base member;

a slidable member adapted for movement along the longitudinal axis of said base member within said recessed track, said slidable member including:

an end portion adapted to slide over said aperture and thereby protect said switch, and means for maintaining said slidable member in contact with said base member, said means comprising at least one elongate cantilever spring member further comprising an integrally formed part of said slidable member so that said slidable member has a resilient bias to project in a direction opposite from said base member; and a top member having an aperture adapted to circumscribe said end portion of said slidable member, said top member adapted to contact said base member at the outer edges of said base member thereby permitting said slidable member to move between and relative to said top and base members within said recessed track.

2. A switch cover comprising:

an elongate base member having an aperture adapted to circumscribe a switch;

a top member; and a slidable member adapted for movement along a longitudinal axis of said base member, said slidable member including:

an end portion adapted to slide over said aperture and thereby protect the switch, and means for maintaining said slidable member in contact with said top member, said means comprising at least one elongate cantilever spring member further comprising an integrally formed part of said slidable member so that said slidable member has a resilient bias to project in a direction opposite from said top member, said top member having an aperture adapted to circumscribe said end portion of said slidable member and having a recessed track extending along a central portion of the longitudinal axis of said top member, wherein said slidable member is adapted for relative movement within said recessed track.

* * * * *